US005265968A

United States Patent [19]

Atkins

[11] Patent Number: 5,265,968

[45] Date of Patent: Nov. 30, 1993

[54] FILE CLIP

[75] Inventor: David S. Atkins, Broederstroom, South Africa

[73] Assignee: Arnoldus Adriaan Van Wijk, Transvaal, South Africa

[21] Appl. No.: 907,400

[22] Filed: Jul. 1, 1992

[30] Foreign Application Priority Data

Jul. 2, 1991 [ZA] South Africa ..... 91/5089

[51] Int. Cl.[5] ..... B42F 13/10

[52] U.S. Cl. ..... 402/63; 402/68

[58] Field of Search ..... 402/61, 63, 64, 65, 402/68, 80 R, 80 P

[56] References Cited

U.S. PATENT DOCUMENTS 3,970,331 7/1976 Giulie ..... 402/63 X
4,305,675 12/1981 Jacinto ..... 402/63 X
4,453,851 6/1984 Purcocks ..... 402/68 X

FOREIGN PATENT DOCUMENTS 2647044 4/1978 Fed. Rep. of Germany ..... 402/63
61789 5/1968 German Democratic Rep. ... 402/68
1494316 12/1977 United Kingdom .
2224469 5/1990 United Kingdom .
WO91/04162 9/1989 World Int. Prop. O. ..... 421.13/10

OTHER PUBLICATIONS

Patents Act 1977, Examiner's report to the Comptroller under Section 17 (The Search Report) Form SF2(p).

*Primary Examiner*—Paul A. Bell
*Attorney, Agent, or Firm*—Barnes & Thornburg

[57] ABSTRACT

A file clip which has a base with two spaced elongate, flexible, serrated members, and a retainer with two spaced apertures through which the members pass. Punched paper sheets are threaded on to the elongate members. Adjacent each aperture the retainer has a flexible tab which is flanked by two upstanding undercut formations. The tab has locking formations which are engageable with selected serrations on the respective elongate member thereby to secure the retainer to the base.

3 Claims, 3 Drawing Sheets

FILE CLIP

BACKGROUND OF THE INVENTION

This invention relates to a file clip which is a device used for example for retaining documents in a file folder or, more simply, secured to one another.

SUMMARY OF THE INVENTION

The invention provides, in the first instance, a base component for a file clip which includes a base member and at least one elongate flexible member which extends from the base member, the elongate flexible member including a plurality of anchor formations at spaced intervals along its length.

The anchor formations may comprise serrations, teeth or similar formations.

Two of the elongate flexible members may be provided at spaced locations on the base member.

The invention also provides a retaining component for a file clip which includes a body, at least one aperture formed in the body, and at least one locking formation adjacent the aperture.

The retaining component may include at least one upstanding and undercut formation adjacent the said at least one locking formation.

Preferably the body includes a flexible tab member and the said at least one locking formation is located on the tab member.

In one embodiment the body is formed with two spaced slits which define a flexible tab member and two opposed undercut formations on respective opposed sides of the tab member, the said at least one locking formation being located on the tab member.

The body may be formed with two slots on respective outer sides of each of the undercut formations.

The invention also extends to a file clip which includes a base component of the aforementioned kind and a retaining component of the aforementioned kind, the or each elongate flexible member of the base component being passed through a respective aperture in the body, the said at least one locking formation adjacent the aperture being engageable with at least one of the said plurality of anchor formations on the elongate flexible member.

The invention further provides a file clip which includes a base component with at least one elongate flexible member which extends from the base component and which has a plurality of anchor formations, and a retaining component which is engageable with the elongate flexible member and which is movable relatively thereto, and which includes at least one locking formation which is engageable with at least one selected anchor formation thereby to restrain the retaining component against movement relatively to the elongate flexible member in at least one direction.

The retaining component may include a body and a respective aperture through which each elongate flexible member extends. An undercut formation may be provided at or adjacent each aperture and the respective elongate flexible member may be engageable therewith and may be disengageable therefrom by exerting force on the elongate flexible member which causes resilient deflection of the undercut formation.

The invention also extends to a file clip which includes an elongate flexible member with a plurality of anchor formations, and a retaining component with an aperture through which the elongate flexible member extends, the retaining component having at least one locking formation adjacent the aperture which is selectively engageable with at least one of the anchor formations and which permits movement of the elongate flexible member relatively to the locking formation in one direction and which restrains movement of the elongate flexible member relatively to the locking formation in an opposing direction, and opposed undercut formations which overlie peripheral edges of the elongate flexible member adjacent the locking formation, thereby maintaining the locking formation in engagement with the said at least one anchor formation, the undercut formations being resiliently deflectable by exerting force on the elongate flexible member in a direction which urges the elongate flexible member away from the locking formation between the undercut formations.

BRIEF DESCRIPTION OF THE DRAWINGS

The invention is further described by way of examples with reference to the accompanying drawings in which.

DESCRIPTION OF PREFERRED EMBODIMENTS

Figure 1:
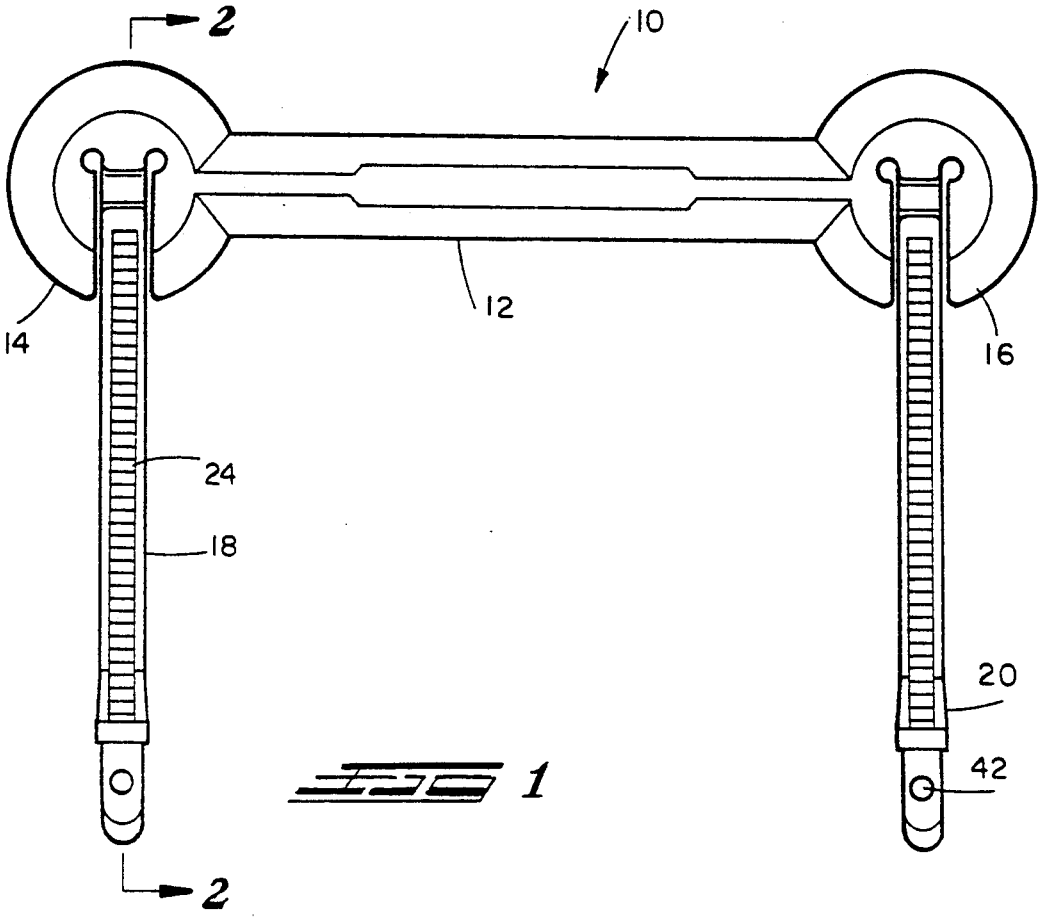
FIG. 1 is a plan view of a base component used in a file clip according to the invention.

FIG. 1 of the accompanying drawings illustrates a base component 10 which is used in a file clip according to the invention. The base component is moulded using any suitable technique from a plastics material which exhibits desired properties of resilience and flexibility.

The base component includes a base member defining a central portion 12 with opposed substantially circular sections 14 and 16 at opposed ends of the portion 12.

Figure 2:
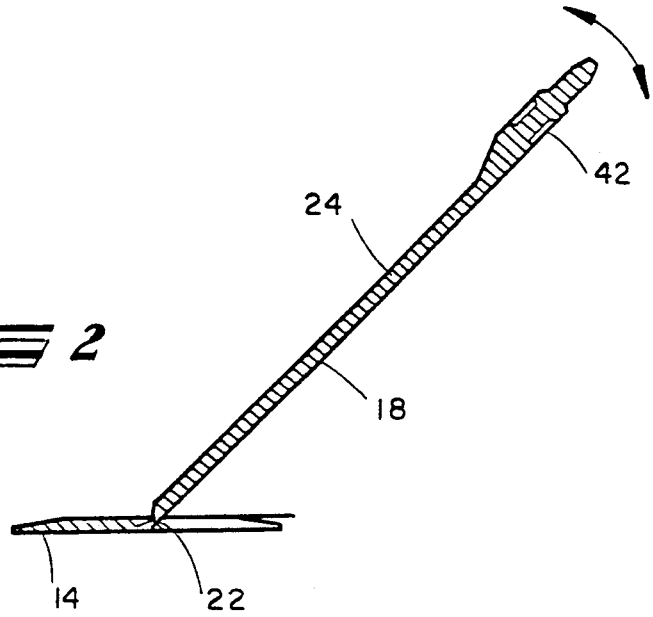
FIG. 2 is a cross sectional view through the component of FIG. 1 taken on the line 2—2.

Elongate flexible members 18 and 20 extend from the respective circular sections 14 and 16. At the time of manufacture of the base component the flexible members 18 and 20 extend laterally to one side of the base component. However as is shown in FIG. 2, which is a cross sectional view taken on the line 2—2 of FIG. 1, it is apparent that each elongate flexible member can be bent upwardly so that it projects more or less vertically from the plane in which the respective circular section lies. To facilitate this bending movement each elongate flexible member is secured to its respective circular section at a narrow necked portion 22.

Figure 4:
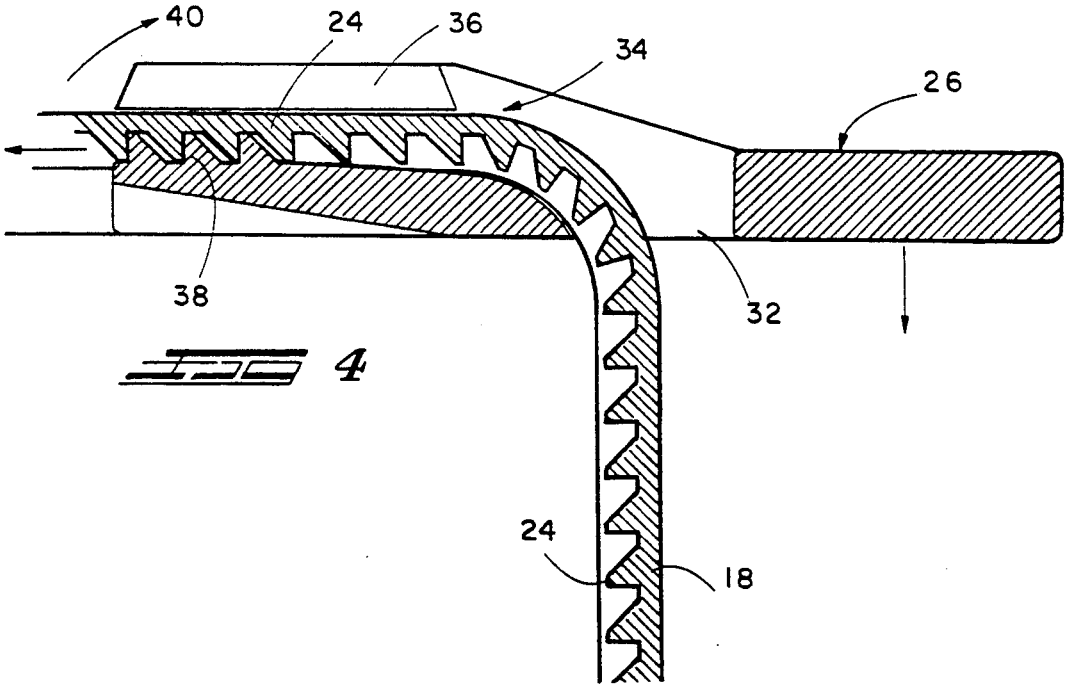
FIG. 4 is an enlarged cross sectional view taken on the line 4—4 of FIG. 3 when the retaining component is engaged with the base component.

The upper surface of each elongate flexible member carries a plurality of anchor formations 24 which are in the nature of teeth or serrations, and which are shown in more detail in FIG. 4.

Figure 3:
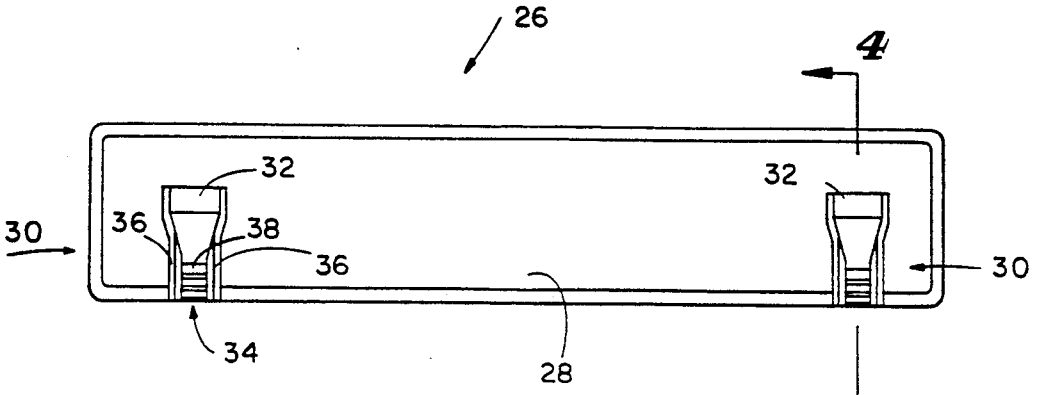
FIG. 3 is a plan view of a retaining component which together with the base component of FIG. 1 makes up a file clip according to the invention.

FIG. 3 shows a retaining component 26 which is made from the same plastics material which is used for the component 10. The component 26 includes a body 28 with formations 30 at opposed ends of the body.

Each formation 30 includes a rectangular aperture 32 which is sized to permit a respective elongate flexible member 18 or 20 to pass therethrough, with a small tolerance. A channel 34 extends from the aperture 32 to one side of the body. The channel is open to an upper side of the body and is flanked by two upstanding sections which carry undercut formations 36 which face each other. Extending upwardly from the base of the channel are a number of locking formations 38.

In use of the file clip the base component 10 is attached to a surface of a file folder, not shown. The attachment of the base component may be achieved for example by passing the elongate flexible members 18 and 20 through holes which are punched in the file cover. Preferably however the underside of the base component carries an adhesive so that the base component can be stuck to the file cover at a desired location without making holes in the file cover.

Sheets of paper which are to be secured to one another or to the file cover are punched with holes, in a known manner, and the elongate flexible members 18 and 20 are passed through the holes so that the papers are assembled stacked one above the other in a neat array.

The retaining component 26 is placed over the base component and the two elongate flexible members 18 and 20 are passed through the respective apertures 32. The retaining component is pressed down on to the upper surface of the uppermost sheet of paper in the stacked array and each elongate flexible member is then pulled downwardly, as shown in FIG. 4, so that it passes between the undercut formations 36 which are resiliently deformed.

The anchor formations 24 then engage with the locking formations 38, as shown in FIG. 4, thereby fixing the retaining component to the two elongate flexible members.

The anchor formations 24 and the locking formations 38 are oriented so that it is possible to pull each elongate flexible member along the respective channel 34 and so move the retaining component 26 downwardly, closer towards the base component 10. It is apparent however that movement of the elongate flexible members in a reverse direction is not possible.

If the retaining component 26 is to be disengaged from the base component then each elongate flexible member is raised in the direction of an arrow 40, as shown in FIG. 4. Force is applied to the protruding end of the respective elongate flexible member in an upwards direction so that the undercut formations 36 are resiliently deflected and the elongate flexible member can pass between them and so be removed from the channel 34. The retaining component can then be removed and further sheets of paper can be placed on the stack of papers which are already engaged with the elongate flexible members, or papers can be removed from the stack, according to requirement. The retaining component 26 is then re-engaged with the elongate flexible members in the manner which has been described.

The invention has been described with reference to a file clip which has two elongate flexible members. This number is however not restricted and the file clip can be formed with more than two elongate flexible members or, when required, with only one elongate flexible member.

FIGS. 1 and 2 show that the flexible elongate members 18 and 20 have shaped ends which includes protrusions 42. A cross piece, which may be U-shaped and which is not shown, may be clipped on to the ends of the flexible elongate members, and is then kept in position by the protrusions 42 which engage with recesses in the respective ends of the cross piece.

The cross piece allows for movement of the sheets of paper along the flexible elongate members, without the sheets becoming detached therefrom.

Figure 5:
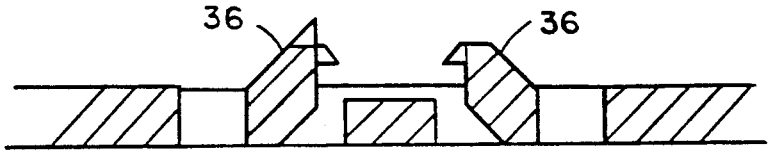
FIGS. 5 and 6 are enlarged cross-sectional and plan views respectively of a modified portion of a retaining component.
Figure 6:
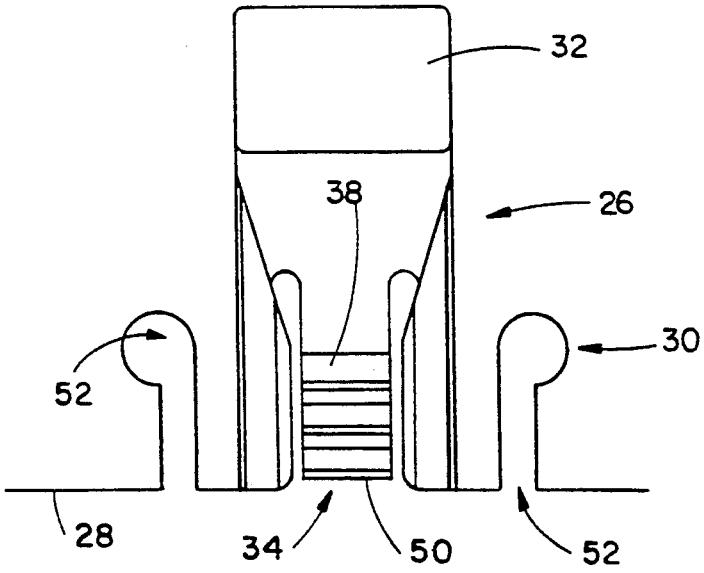

FIGS. 5 and 6 illustrate in cross section and in plan respectively, and in enlarged detail, a modified form of construction for the retaining component 26. The modification resides in a variation of the shape of each formation 30.

As in the case with the arrangement shown in FIGS. 3 and 4, for each formation 30, a rectangular aperture 32 formed through the body 28 is positioned adjacent a channel 34 which extends to one side of the body. Flanking the channel are opposed upstanding sections with undercut formations 36 which partly overlie the base of the channel. A tab 50 lies on the base of the channel and is separated from the remainder of the body by two narrow slits. The tab 50 carries locking formations 38 of the nature described in connection with FIGS. 3 and 4.

The tab 50 is connected to the body only at its base and consequently is flexible relatively to the body.

Two cut outs or slots 52 are formed in the body on an outer side of each respective undercut formation 36. The undercut formations 36 are therefore flexible to a limited extent relatively to the remainder of the body 28.

The modified retaining component, as shown in FIGS. 5 and 6, is used in the same way as what has been described with reference to FIGS. 1 to 4 in that the elongate flexible members 18 and 20 of the base component 10 are passed through the respective rectangular apertures 32 and thereafter are pulled down between the opposing undercut formations 36 so that the anchor formations 24 are brought into engagement with the locking formations 38 on the tabs.

As has been pointed out the cut outs 52 make the undercut formations 36 more flexible and it is therefore relatively easy to engage the elongate flexible members 18 and 20 with the respective tabs.

I claim:

1. A file clip which includes at least one elongate flexible member with a plurality of anchor formations, and a retaining component with at least one aperture through which the elongate flexible member extends, the retaining component having at least one locking formation to one side of the aperture which is selectively engageable with at least one of the anchor formations and which permits movement of the elongate flexible member relatively to the locking formation in one direction and which restrains movement of the elongate flexible member relatively to the locking formation in an opposing direction, and opposed undercut formations which overlie peripheral edges of the elongate flexible member adjacent the locking formation, thereby maintaining the locking formation in engagement with the said at least one anchor formation, the undercut formations being resiliently deflectable by exerting force on the elongate flexible member in a direction which urges the elongate flexible member away from the locking formation between the undercut formations.

2. A file clip according to claim 1 wherein the elongate flexible member bends relative to the retaining component during movement of the elongate flexible member after it is passed through the aperture and as it is manipulated into engagement with the locking formation.

3. A file clip according to claim 1 wherein the at least one locking formation is carried on a flexible tab member which is formed between two spaced slits.

* * * * *